US012538957B1

(12) United States Patent
Dale

(10) Patent No.: US 12,538,957 B1
(45) Date of Patent: Feb. 3, 2026

(54) STABLE CUSHIONING FOOTWEAR CONSTRUCTION

(71) Applicant: Wolverine Outdoors, Inc., Rockford, MI (US)

(72) Inventor: Dewayne Dale, Howard City, MI (US)

(73) Assignee: Wolverine Outdoors, Inc., Rockford, MI (US)

( * ) Notice: Subject to any disclaimer, the term of this patent is extended or adjusted under 35 U.S.C. 154(b) by 0 days.

(21) Appl. No.: 18/891,399

(22) Filed: Sep. 20, 2024

(51) Int. Cl.
*A43B 13/18* (2006.01)
*A43B 7/144* (2022.01)
*A43B 13/12* (2006.01)

(52) U.S. Cl.
CPC ..... *A43B 7/144* (2013.01); *A43B 13/125* (2013.01); *A43B 13/186* (2013.01)

(58) Field of Classification Search
CPC ..... A43B 13/125; A43B 13/186; A43B 13/12; A43B 13/122; A43B 13/127; A43B 7/144
See application file for complete search history.

(56) References Cited

U.S. PATENT DOCUMENTS 7,451,557 B2 11/2008 McDonald et al.
10,834,998 B2 11/2020 Workman et al.
11,439,199 B2 9/2022 Schulten et al.
2007/0101613 A1* 5/2007 Rosendahl ..... A43B 7/144 36/29
2011/0126422 A1* 6/2011 Vattes ..... A43B 13/145 36/28
2014/0075779 A1* 3/2014 Bruce ..... A43B 13/181 36/29
2021/0145119 A1* 5/2021 Campos, II ..... A43B 13/20
2021/0259356 A1* 8/2021 Maselino ..... A43C 1/06
2022/0202136 A1* 6/2022 Campos, II ..... A43B 13/206

* cited by examiner

*Primary Examiner* — Bao-Thieu L Nguyen
(74) *Attorney, Agent, or Firm* — Warner Norcross + Judd LLP

(57) ABSTRACT

A footwear construction is provided with a sole assembly having underfoot cushion elements disposed through a support frame to yield enhanced stability for the sole assembly. The cushion elements and the corresponding apertures through the frame can be in a forefoot region and/or a heel region and can occupy a majority of those regions. The frame can be constructed from one material and the midsole from another material softer or having a lower durometer. The midsole can include a peripheral groove into which an outer frame wall of the frame can be interlocked to further stabilize the cushion elements which are interior to the frame. The midsole can include an exterior midsole wall, and that wall and the frame wall can include corresponding teeth and recesses that further interlock the frame and midsole to augment structural support and stability, without substantially reducing the underfoot cushion provided by the midsole.

20 Claims, 8 Drawing Sheets

STABLE CUSHIONING FOOTWEAR CONSTRUCTION

BACKGROUND OF THE INVENTION

The present invention relates to footwear, and more particularly to a sole assembly for an article of footwear.

Most conventional footwear include an upper and a sole assembly. The general function of the upper is to receive a wearer's foot and secure it to the sole assembly. Uppers are available in a wide variety of shapes and styles for forming a broad range of categories of footwear, such as work boots, dress boots, outdoor boots, casual shoes, athletic shoes and performance shoes. Sole assemblies also come in a variety of configurations with varying support, comfort and traction features corresponding to the needs of the foregoing categories. The sole assembly is secured to the undersurface of the upper and its general function is to provide protection for the wearer's foot inside the upper. The sole assembly can be designed not only to protect the foot from contact with the ground, but also to provide improved cushion and support for the foot.

There is an ongoing effort to develop new and improved footwear sole constructions that provide optimal performance across various applications. To provide enhanced support and stability, it is not uncommon to incorporate a relatively rigid plate spanning underfoot within a sole assembly. The plate can provide stability to a wearer by forming a relatively stable platform. Typically, however, a soft layer of foam is disposed above the plate to provide cushion under the wearer's foot. This, however, compromises the stability provided by the sole assembly because the softer foam layer can roll and deform over the plate, allowing the wearer's foot to also shift and move above the plate, producing a feeling of instability, particularly on uneven surfaces. In some cases, the cushioning effect of the soft layer also can be reduced because the soft layer is reinforced by the plate. As a result, incorporation of a hard plate or other structures into a sole assembly typically requires a balance between the competing objectives of providing cushion on the one hand and support and stability on the other hand.

Despite continuing efforts, there remains a need for a sole assembly that provides an appropriate balance between comforting cushion and stability.

SUMMARY OF THE INVENTION

A footwear construction is provided with a sole assembly combining exceptional underfoot comfort via durable cushion elements disposed in a support frame that yields enhanced stability to the sole assembly.

In one embodiment, the footwear construction can include an upper joined with the sole assembly. The sole assembly can include the support frame and one or more cushion projections extending upward from a midsole base into one or more apertures defined by the frame. The cushion projections or cushions, and the corresponding apertures can be located in a forefoot region and a heel region and can consume a majority of space in those areas.

In another embodiment, the frame can be constructed from a first material and the midsole under the frame can be constructed from a second material softer or less rigid than the first material, optionally having a lower durometer than the first material. With the frame being more rigid, it can provide support and stability to the cushion projections disposed in and at least partially through the frame.

In another embodiment, the apertures can include a large forefoot aperture, generally formed to extend under one or more metatarsalphalangeal joints in a foot of a user and a large heel aperture, generally formed to extend under a heel of the foot of the user. The forefoot and heel apertures optionally can span a majority of each of the respective forefoot and heel regions of the sole assembly or footwear in general, from a medial side of a longitudinal axis of the sole assembly to a lateral side thereof. The cushions can be flush with the inside of the frame to provide a generally contiguous upper surface of the sole assembly upon which an optional Strobel board of an upper can be disposed and/or secured.

In still another embodiment, the frame can include a frame bridge extending transverse and across a longitudinal axis of the frame and located in an arch region that is between the heel region and the forefoot region. The frame bridge can tie lateral and medial parts of a frame wall to one another for enhanced structural rigidity and torsion resistance.

In yet another embodiment, the midsole can define a peripheral recess, which can be in the form of a groove, extending around at least a portion of cushions of the midsole. The peripheral recess can be located between the cushions and a midsole exterior wall formed and projecting from the midsole base distal from the cushions. The frame can interlock with the midsole about the cushions, with a frame wall being nested in the peripheral recess around a perimeter of one or more of the cushions.

In even another embodiment, the midsole exterior wall and/or the frame wall can include first teeth, and the other of the midsole exterior wall and/or the frame wall can define first recesses. The first teeth can be disposed in the first recesses to interlock the midsole exterior wall and the frame wall.

In a further embodiment, the sole assembly can include an outsole disposed under the midsole, which can be under the frame. The outsole and frame can be separate and independent components of the sole assembly. The outsole can provide a ground contacting surface of the sole assembly.

In still a further embodiment, the outsole can include an exterior outsole wall. The midsole exterior wall and/or the exterior outsole wall can include second teeth. The other of the midsole exterior wall and/or the exterior outsole wall can define second recesses. The second teeth can be disposed in the second recesses to interlock the midsole exterior wall and the exterior outsole wall.

In yet a further embodiment, the first recesses, first teeth, second recesses and second teeth can be vertically aligned one above the other. The frame, midsole and outsole thus can be vertically locked one above the other via sets of teeth and recesses. This interlock can further support and rigidify the frame, which in turn can provide stability and support around the one or more internally disposed underfoot cushions, yet still allow those cushions to provide underfoot comfort.

The current embodiments provide a footwear construction that provides an evolved and enhanced form of support cushioning for static conditions as well as dynamic movements of a user wearing the footwear.

These and other objects, advantages, and features of the invention will be more fully understood and appreciated by reference to the description of the current embodiment and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DETAILED DESCRIPTION OF THE CURRENT EMBODIMENTS

Figure 1:
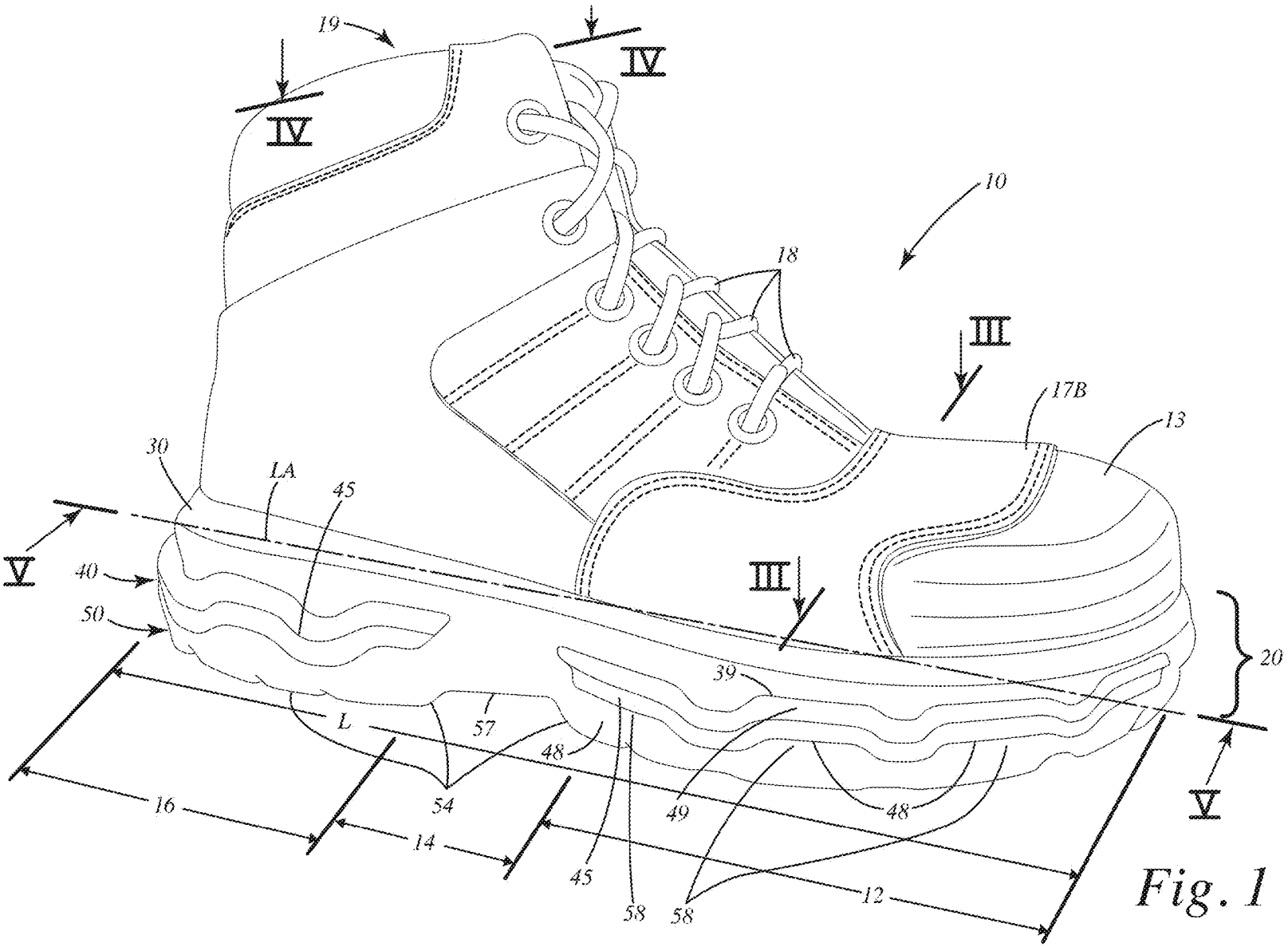
FIG. 1 is a perspective side view of the footwear construction of a current embodiment.

A current embodiment of the footwear construction is shown in FIGS. 1-5 and generally designated 10. In this embodiment, the footwear includes a sole assembly 20 including a support or stability frame 30, a softer cushioning midsole 40 and an outsole 50. The midsole 40 can include a forefoot cushion projection 41 projecting in a forefoot aperture 31 defined by the frame 30, and a heel cushion projection 42 projecting in a second or heel aperture 32. These cushions can be located under a board 17, such as a Strobel board or insole board, of an upper 11 of the footwear 10 to provide direct underfoot cushioning and comfort. The cushions, however, can be surrounded by walls and parts of the stability frame 30 about their perimeters to stabilize the softer cushion projections with a firmer, more rigid structure as described below. Thus, while providing a comfortable underfoot cushion, the sole assembly can feel stable and well supported to a wearer.

Although the current embodiment is illustrated in the context of a laced work boot, it may be incorporated into any type or style of footwear, including ranch boots, western style boots, hiking boots, performance shoes, trail shoes, all-terrain shoes, running shoes, athletic shoes, sneakers, walking shoes, multisport footwear, casual shoes, dress shoes or any other type of footwear or footwear components. Generally, the shoe is well suited for hard terrain and surfaces, as well as rough, uneven terrain having a variety of different types of underfoot features that may engage the footwear. Such surfaces optionally can be those found at a construction or job site (indoor or outdoor), in a warehouse, shop or other work facility.

It also should be noted that directional terms, such as "vertical," "horizontal," "top," "bottom," "upper," "lower," "inner," "inwardly," "outer" and "outwardly," are used to assist in describing the invention based on the orientation of the embodiments shown in the illustrations. Further, the terms "medial," "lateral" and "longitudinal" are used in the manner commonly used in connection with footwear. For example, when used in referring to a side of the shoe, the term "medial" refers to the inward side (that is, the side facing the other shoe) and "lateral" refers to the outward side. When used in referring to a direction, the term "longitudinal direction" refers to a direction generally extending along the length of the shoe between toe and heel, and the term "lateral direction" refers to a direction generally extending across the width of the shoe between the medial and lateral sides of the shoe. The use of directional terms should not be interpreted to limit the invention to any specific orientation. Further, as used herein, the term "arch region" (or arch or midfoot) refers generally to the portion of the footwear or sole assembly corresponding to the arch or midfoot of the wearer's foot; the term "forefoot region" (or forefoot) refers generally to the portion of the footwear forward of the arch region corresponding to the forefoot (for example, including the ball and the toes) of a wearer's foot; and the term "heel region" (or heel) refers generally to that portion of the footwear rearward of the arch region corresponding to the heel of the wearer's foot. The forefoot region 12, arch region or mid-foot region 14, and heel region 16 generally are identified in FIG. 1. However, it is to be understood that delineation of these regions may vary depending upon the configuration of the sole assembly and/or footwear.

Figure 2:
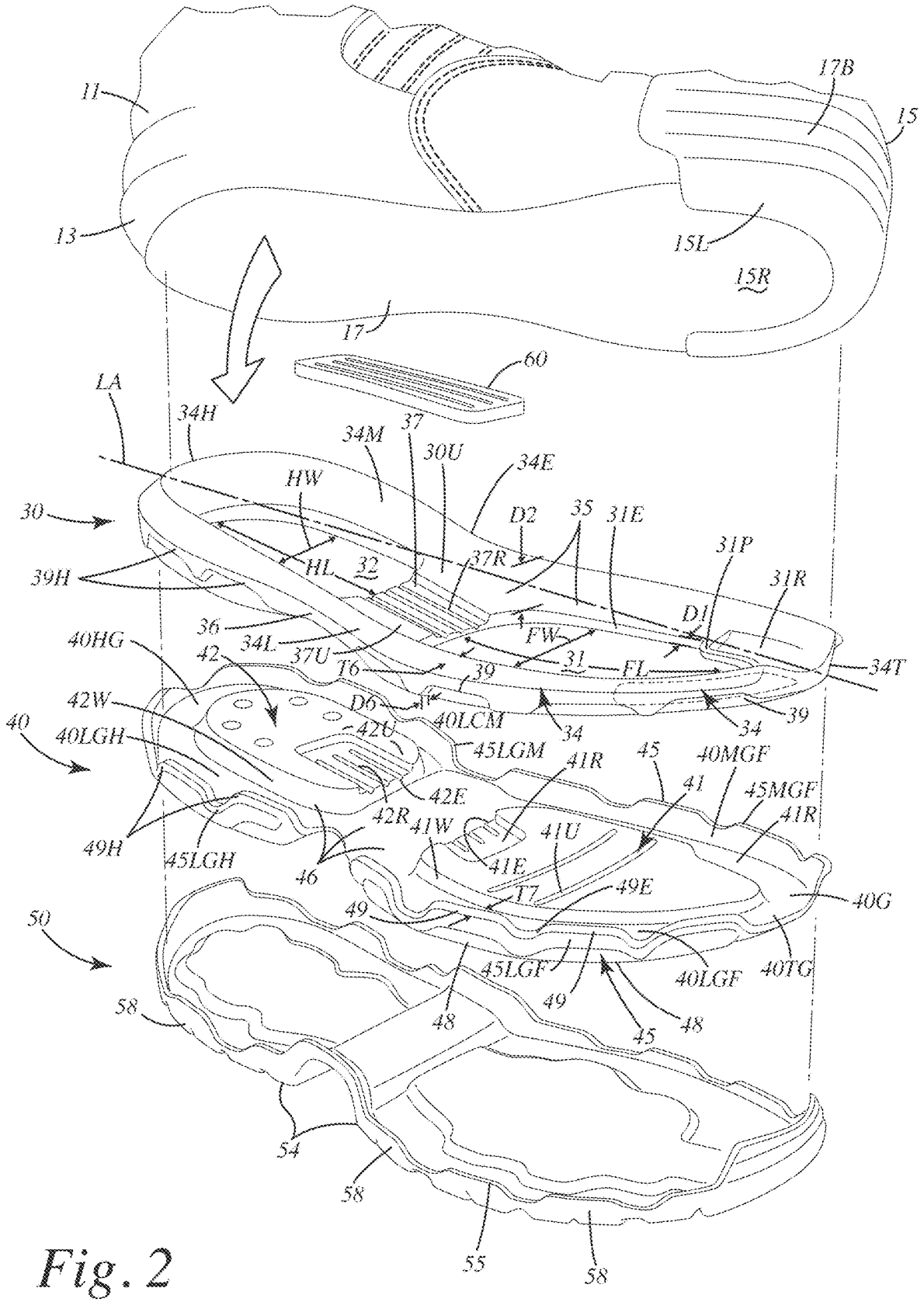
FIG. 2 is a perspective exploded view of the footwear construction.

With reference to FIGS. 1-2, the footwear 10 can include a sole assembly 20. The sole assembly 20 can include the frame 30, the midsole 40 and the outsole 50. The lowermost or ground contacting surfaces of the outsole can include multiple lugs 54, treads, spikes, cleats and/or other features designed to enhance traction between the footwear and an underlying surface. More or fewer elements of the sole assembly 20 can be included in some embodiments. The components of the sole assembly can individually and/or collectively provide the article of footwear 10 with a number of attributes, such as support, rigidity, flexibility, stability, cushioning, comfort, reduced weight, and/or other characteristics. Generally, regardless of which components are present, the sole assembly 20 can form the bottommost portion of the footwear 10 with the outsole 50 including all or a portion of the ground contacting surface of the footwear. The sole assembly 20 can include a side-to-side width W, a heel-to-toe longitudinal length L and a longitudinal axis LA, which can be shared with the footwear, sole assembly, frame, midsole and/or the outsole.

The footwear 10 can include the upper 11 joined with the sole assembly 20, optionally along a lower portion of the upper. The upper 11 can be formed from a variety of material elements joined together to cover all or part of the wearer's foot. The material elements can be selected based on the intended uses of the article of footwear 10, and can include leather, pigskin, synthetic textiles, mesh textiles, 3D printed materials and/or polymers. The upper 11 can be constructed to improve the rigidity of the sole assembly 20. For example, the upper can be constructed from leather, plastic, canvas or other materials. The upper 11 can include one or more closure elements, including for example shoelaces 18. The upper 11 additionally includes an upper opening 19 for receiving the wearer's foot and a lower periphery 13 for attachment to the sole assembly 20.

Optionally, the upper 11 can include or be joined with a protective toe element 15. This protective toe can be of a U shape and configured to be disposed external to the toe box 11B as shown, extending rearward to cover the toes toward and/or over the metatarsalphalangeal joints MTP of the wearer's foot WF in the footwear. In other applications, the protective toe can be internal to the upper. The protective toe 15 can include an internal toe cavity TC bounded by a lower shelf or flange 15L also optionally having a U shape, with a forward extending recess 15R adjacent the flange 15L. This protective toe element 15 can be disposed in one or more dedicated recesses 31R, 41R defined by the frame 30 and/or midsole 40 as described below.

A footbed 17F can be positioned within the void 11V defined by the upper 11. The footbed can be constructed from a sheet of material, such as foam, ethyl vinyl acetate, polyurethane, latex, gel or other materials, and by virtue of its compressibility, provide cushioning, and may also conform to the foot in order to provide comfort, support, and stability. The lower peripheral allowance or edge 13 of the upper can be stitched, cemented, or otherwise fastened to, or loose relative to the footbed around the perimeter of the footbed.

The sole assembly 20 can be joined to the upper 11 with any type of construction, such as a cemented construction, a direct-attach construction (e.g. direct injection molding), pour molding, a Strobel construction, a stitch down construction, a McKay stich construction, a California construction, a force-lasted construction, a slip-lasted construction, a moccasin construction, a direct vulcanizing construction or a welted construction (e.g. Goodyear welt or Blake welt). The upper may be configured to implement the desired footwear construction. For example, the bottom of the upper may be closed with a Strobel board 17 to implement a Strobel construction or with an insole board to implement a direct-attached or welted construction, or a hybrid of any of the foregoing.

Figure 3:
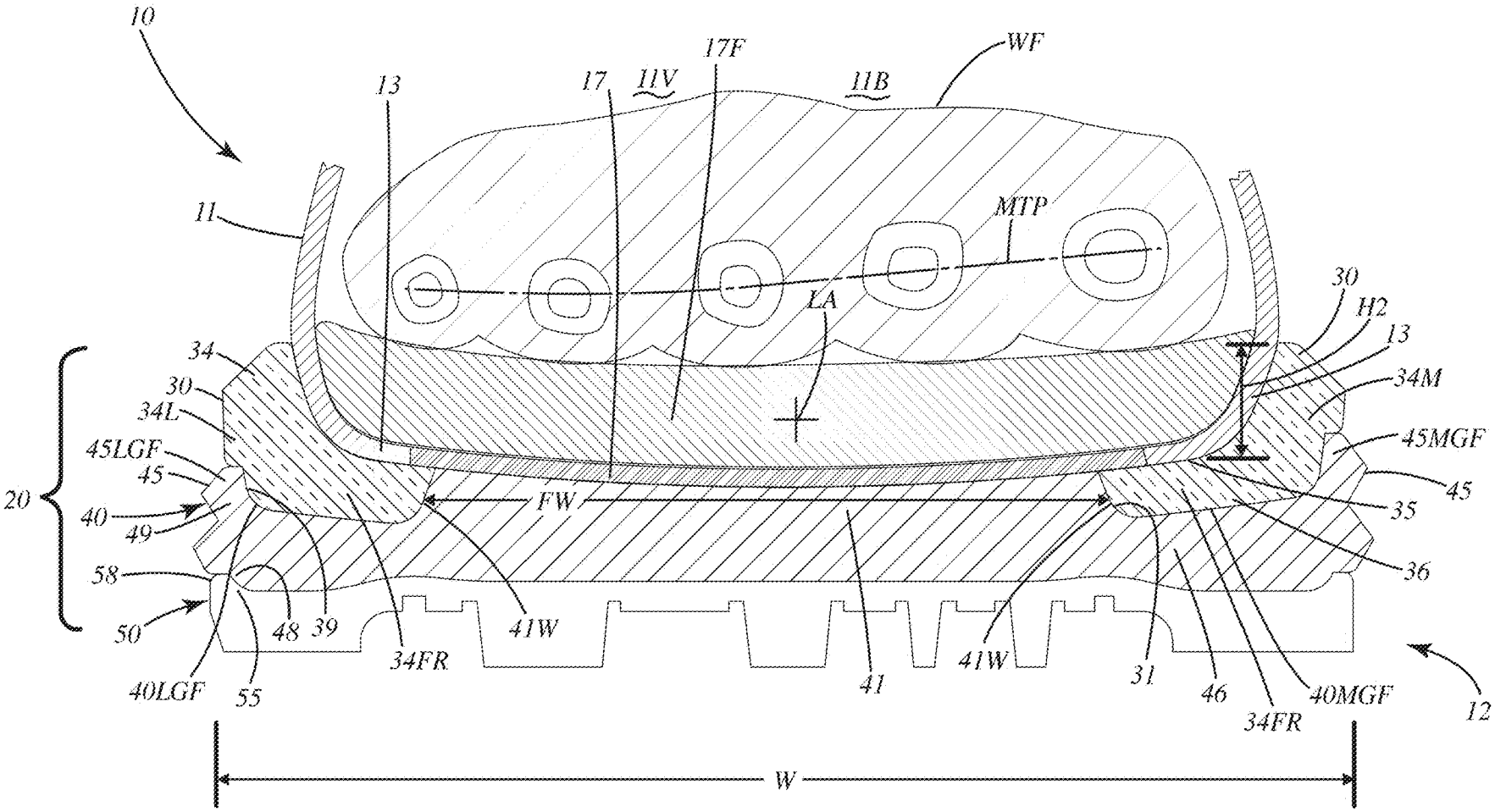
FIG. 3 is a section view of the footwear construction taken along line 3-3 in FIG. 1.
Figure 4:
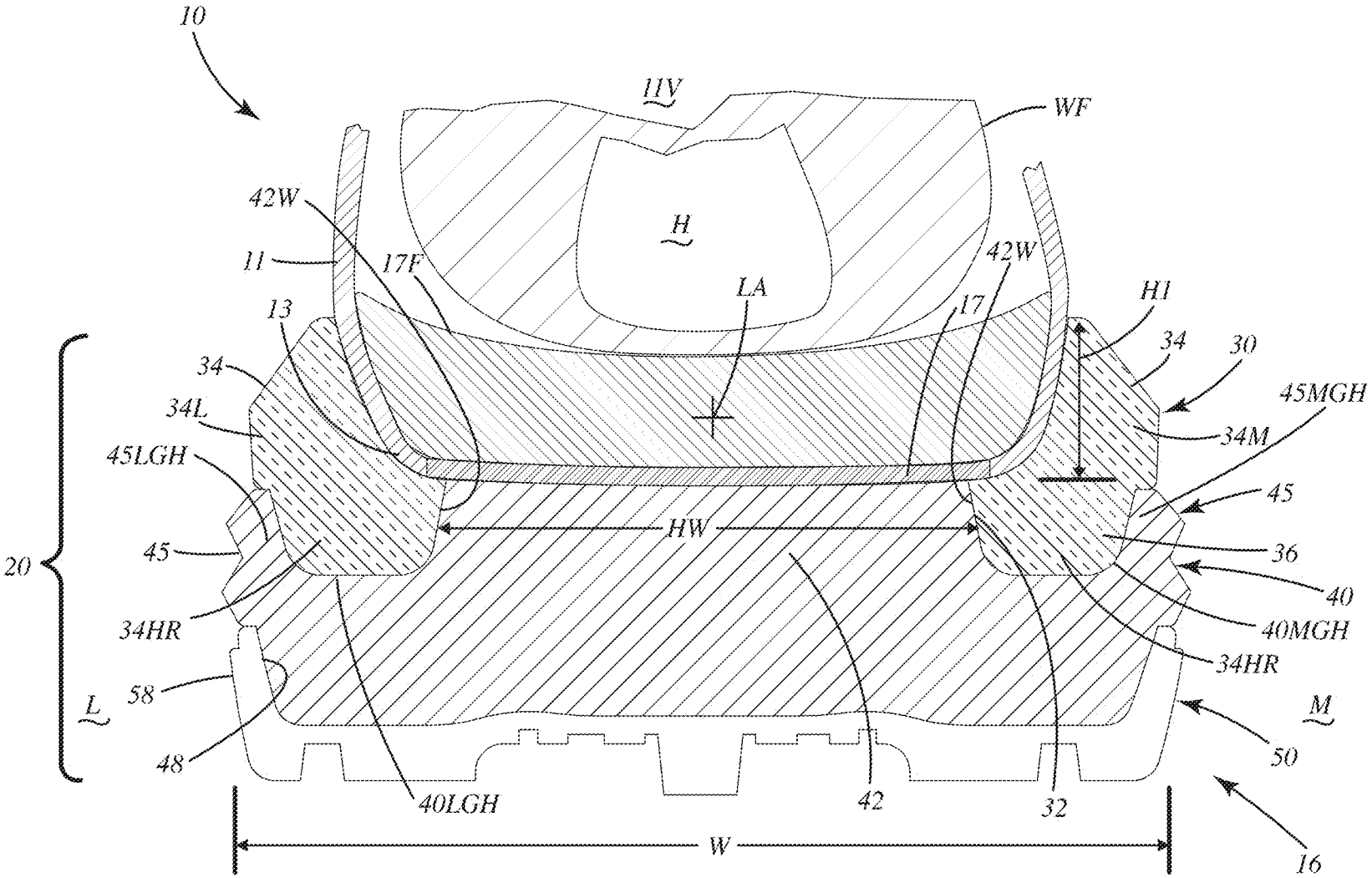
FIG. 4 is a section view of the footwear construction taken along line 4-4 in FIG. 1.

Optionally, in a Strobel construction, the lower peripheral allowance 13 of the upper 11 can be attached to a Strobel board 17 as shown in FIGS. 2-4. The Strobel board 17 can be stitched in a zigzag fashion around the lower peripheral allowance. As shown in FIG. 2, the Strobel board 17 can extend from the toe box 11B through the forefoot region 12, through the arch region 14 and within the heel region 16. In some applications, the Strobel board can be modified under the toe box 11B to accommodate an optional internal protective toe element (not shown). For example, the Strobel board 17 may include a hole or recess so that the protective toe element can directly engage the recesses 31R, 41R as described below. In other applications, the footwear bottom can be closed with an insole board, and welted. The protective toe element can be internal or external to the upper and peripheral allowance and may or may not be disposed in recesses or platforms included in the frame and/or midsole. As shown, however, the protective toe element 15 is external to the upper 11 and interfaces with the sole assembly 20 as described below.

With reference to FIGS. 1-5, the sole assembly 20 again can include a support frame 30, a midsole 40 and an outsole 50. Generally, the frame 30 can be disposed above the midsole 40 which can be disposed above the outsole 50. Each of these components will now be described in detail, starting with the support frame 30. The support frame can be constructed from a variety of materials, however generally the support frame 30 can be constructed from a more rigid, higher durometer, less flexible and more supportive material than the midsole 40. Optionally, the support frame 30 can be constructed from a first material and the midsole 40 can be constructed from a second material. The first material can have a first durometer and the second material can have a second durometer. The first durometer can be greater than the second durometer. Optionally, the first durometer can be 50 Asker C to 65 Asker C, inclusive, and the second durometer can be 35 Asker C to 45 Asker C, inclusive, or the first durometer can be 55 Asker C and the second durometer can be 45 Asker C, or the first durometer can be 50 Asker C and the second durometer can be 40 Asker C, or other combinations of the foregoing.

The frame 30 can be more rigid, inflexible and resistant to deformation, bending and flexing more than the midsole. In this manner, the frame 30 can provide structural rigidity and stability to the midsole and the sole assembly in general. Although the frame can vary from application to application, it can be manufactured from a relatively hard, but not too hard material selected to provide the sole assembly 20 with support and offer stability to the wearer's foot even though it is well cushioned by the midsole 40. For example, the frame 30 can be constructed from a supercritical foam, a relatively hard ethyl vinyl acetate foam ("EVA"), polyurethane ("PU"), a polymer foam mixture, a fiber or other reinforced foam and/or combinations of the foregoing.

The midsole 40 can provide cushioning and comfort underfoot to a wearer due to its softer second material. One of the functions of the midsole can be to provide resilient cushioning for the wearer's foot. Although the midsole can vary from application to application, it can be manufactured from a relatively resilient material selected to provide the sole assembly with a desired level of cushioning. For example, the midsole 40 can be formed from EVA foam, expanded thermoplastic polyurethane ("E-TPU") foam, thermoplastic elastomer ("TPE") foam, PU foam or other materials. The specific characteristics of the selected foam may vary from application to application.

As described below, portions of the midsole 40 can be both below and can extend through the frame 30 for positioning directly underfoot, optionally adjacent a Strobel board 17 or insole board that closes a bottom of the upper 11 so that the users foot transfers force and weight directly through the Strobel or insole board to the midsole 40 in some regions, rather than to the support frame 30. The support frame 30 can surround, encompass and/or form a perimeter around the softer material midsole to contain it and provide stability in some regions or generally to the sole assembly.

As shown in FIGS. 2-5, the frame 30 can be joined with the upper 11 and particularly the lower peripheral allowance 30 thereof. The frame 30 can extend longitudinally, along the longitudinal axis from the forefoot region 12 to the arch region 14 and to the heel region 16. The frame can include the longitudinal axis LA as described above. The frame 10 can define a forefoot aperture 31 and a heel aperture 32. The forefoot aperture 31 can be defined in the forefoot region 12 and can extend under a metatarsalphalangeal joint MCP of the wearer's foot WF when the foot is disposed inside the footwear 10. The aperture 31 can include a length FL and a width FW. The length FL can be greater than the width FW. The length FL can span a majority of the forefoot region 12. The width FW can span a majority of the width W of the sole assembly 20 for example, as shown in FIG. 3. The forefoot aperture 31 optionally can be the only aperture extending through the frame 30 in the forefoot region. The forefoot aperture 31 can be interrupted by a support plate 31P that extends inwardly into the aperture 31. The support plate 31P can define a recess 31R in which the protective toe 15 can at least partially be disposed. For example, the lower flange 15L of the protective toe 15 can be disposed in the recess 31R. The lower flange 15L of the protective toe can be cemented, adhered or otherwise fixed in the recess 31R. In some cases, the recess may be absent and the flange 15L can simply rest upon the plate 31P. The plate 31P and the recess 31R can be of a generally U shape and can extend forwardly around the forefoot region of the frame 30. The plate 31P can extend inward a distance D1 from the edge 31E of the frame surrounding the forefoot aperture.

As shown in FIGS. 1-5, the frame 30 can include a frame wall 34 which can extend around the perimeter of the frame, optionally around a corresponding portion of the upper 11 and the lower peripheral allowance 13 of the upper end or a portion of the protective toe 15. The frame wall 34 can extend through the forefoot region 12, the arch region 14 and the heel region 16 and can include a lateral wall portion 34L and a medial wall portion 34M disposed on opposite sides of the longitudinal axis of the sole assembly and/or the frame 30. The frame wall 34 can extend upward the distance D2 from a bearing surface 35 of the frame 30 to an uppermost edge 34E of the frame wall. The uppermost edge 34E can be disposed above the lower peripheral allowance 13 and/or the Strobel board or insole board 17 of the footwear 10. The lateral frame wall 34L and medial frame wall 34M can be disposed on opposite sides of the forefoot aperture 31 and the heel aperture 32, and the wall frame wall 34 can extend upwardly from the frame base 36. The forefoot aperture and the heel aperture optionally can be the only apertures defined entirely through the frame base 36 in the forefoot region and the heel region, with zero other apertures defined there.

Optionally, the lateral frame wall 34L and the medial frame wall 34M can be joined with one another via a frame bridge 37. This frame bridge 37 can extend through the arch region and can separate the forefoot aperture 31 and the heel aperture 32 or generally can form a boundary of the frame forward of the heel aperture 32 or a boundary of the forefoot aperture 31 reward of the forefoot aperture. The lateral frame wall 34L and the medial frame wall 34M can be joined with one another forward of the forefoot aperture 31 and rearward of the heel aperture 32 by a respective toe frame wall 34T and heel frame wall 34H. The heel frame wall 34H and portions of the lateral frame wall 34L and medial frame wall 34M in the heel region can be of height H1 and can cooperatively form at least a portion of a heel cup that provides more lateral and medial support around a heel of a wearer in the heel region 16. In contrast, the lateral frame wall 34L and the medial frame wall 34M in the forefoot region 12, as shown in FIG. 3 can be of a height H2 that is less than the height H1. This lesser height H2 can provide lateral stability and torsion resistance in the forefoot, yet not overly cramp or crowd the user's foot inside the upper.

As mentioned above, the frame 30 also or alternatively can define a heel aperture 32. This heel aperture can be rearward of the frame bridge 37 and generally disposed in the heel region 16. The heel aperture can be configured to extend under a heel H of the wearer's foot WF when in the footwear 10 as shown in FIG. 4. Again, the heel aperture 32 and forefoot aperture 31 can be separated by the frame bridge 37 which can extend transverse and across the longitudinal axis LA. The heel aperture 32 can extend for a length HL and a width HW in the heel region 16. The length HL can be a majority of the heel region 16 along the longitudinal axis LA. The width HW can extend across a majority of the width W of the sole assembly 20 in the heel region 16. Both the heel aperture and the forefoot aperture can extend completely through the frame 30 and in particular the frame base 36.

As shown in FIGS. 2-4, the sole assembly 20 can include the midsole 40 which dynamically and functionally interfaces with the support frame 30. The midsole can extend from the forefoot region 12 through the arch region 14 and into the heel region 16. The midsole again can be constructed from a second material having a second diameter that is less than the first durometer of the frame 30. The midsole 40 can include a midsole base 46 which can extend optionally throughout the forefoot region, arch region and heel region. The midsole can include a forefoot cushion or forefoot cushion projection 41 and a heel cushion or heel cushion projection 42. The forefoot cushion projection 41 can extend into and/or through the forefoot aperture 31 and can be configured to extend under the metatarsalphalangeal joint MTP of the individual metatarsals in the wearer's foot WF as shown in FIG. 3. The cushion 41 and aperture 31 also can extend under 1, 2, 3, 4 or 5 metatarsalphalangeal joints MTP of the wearer's foot WF. That forefoot cushion projection 41 also can extend across the width FW corresponding to the aperture and can substantially fill the aperture across that width. The cushion projection 41 can be of a length that substantially fills the length FL of the forefoot aperture 31. Likewise, the heel cushion projection 42, shown in FIG. 4 can extend across and fill a substantial portion of the width HW of the heel aperture 32.

Figure 5:
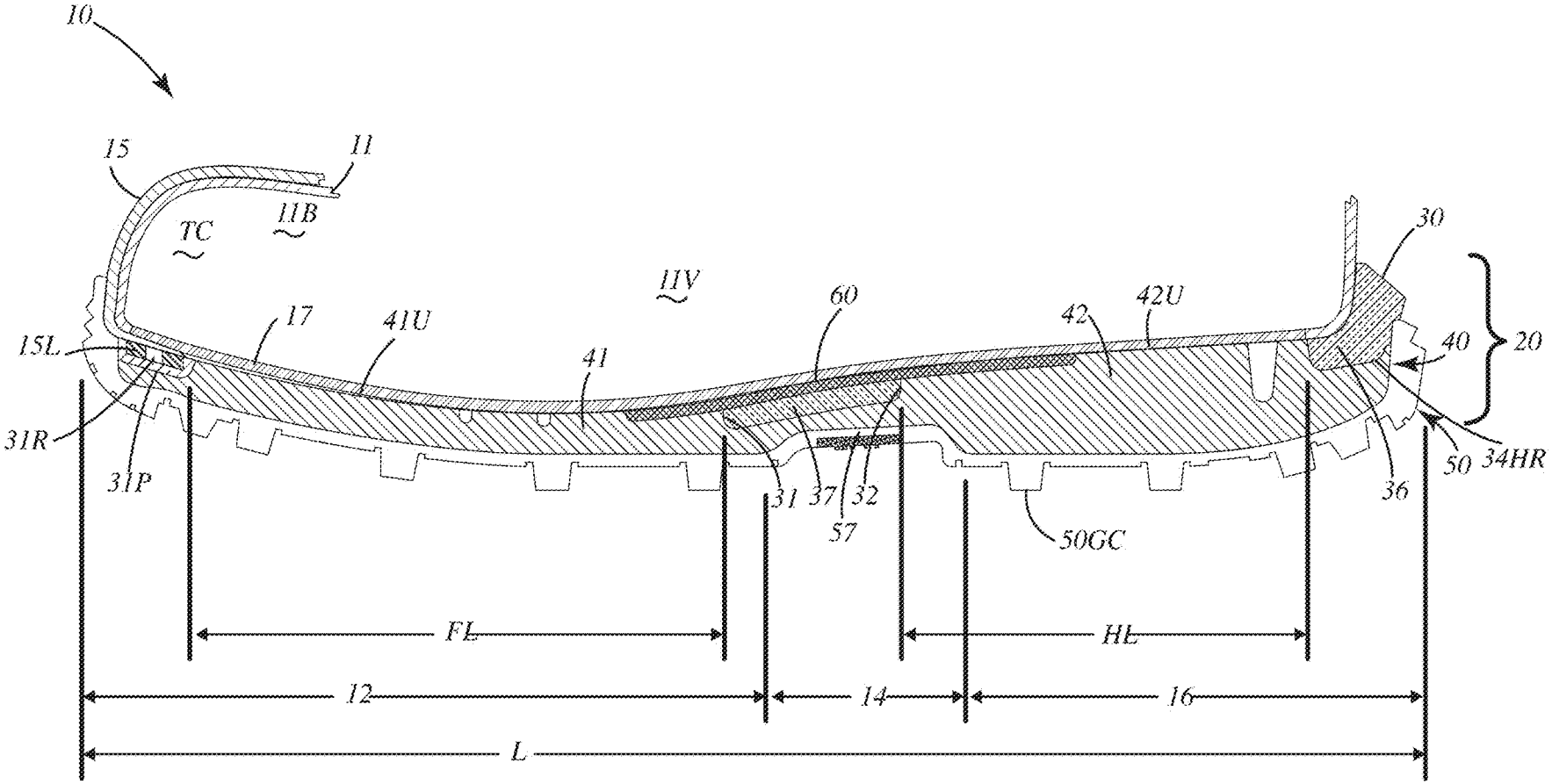
FIG. 5 is a section view of the footwear construction taken along line 5-5 in FIG. 1.

As shown in FIG. 5, the forefoot cushion projection 41 can extend along a majority of the length of the forefoot region 12 and substantially through the length FL of the forefoot aperture 31. The heel cushion projection can extend along a majority of the length of the heel region 16 and a majority of the length of HL of the heel aperture 32. The forefoot cushion projection 41 can extend substantially the length and width of the forefoot aperture so that the forefoot aperture can be filled with the forefoot cushion and the forefoot cushion can extend to the edges surrounding the forefoot aperture. Likewise, the heel cushion projection 42 can extend substantially the length and width of the heel aperture so that the heel aperture can be filled with the heel cushion and the heel cushion can extend to the edges surrounding the heel aperture 32.

Optionally, the forefoot cushion and heel cushion can include upper surfaces 41U and 42U. These upper surfaces can be flush with the upper surface 30U of the frame base 36 in the forefoot region and the heel region. These upper surfaces also can be flush with portions of the upper surface 37U of the frame bridge 37 that is disposed between the respective forefoot cushion 41 and heel cushion 42. Of course, in some applications, the upper surfaces 41U and 42U might be recessed and/or extend above the upper surface of the frame base 30U.

In some applications, the frame 30 and/or midsole 40 can be reinforced through the arch region 14 with a shank 60. As shown in FIGS. 2 and 5, the shank 60 can extend through the arch region 40 and optionally into the heel region 16 and/or the forefoot region 12. The shank 60 can be recessed relative to the upper surfaces of the cushion projections and the frame bridge 37. For example, the shank can extend over the heel cushion projection 42, the frame bridge 37 and/or the forefoot cushion projection 41. Further optionally, these components can define recesses to receive simultaneously the shank 60 therein. As an example, the frame bridge 37 can define a bridge recess 37R, the forefoot cushion projection 41 can define a forefoot cushion projection recess 41R, and the heel cushion projection 42 can define a heel cushion projection recess 42R. The shank can be simultaneously disposed in the bridge recess 37R, the forefoot cushion projection recess 41R and the heel cushion projection recess 42R. Optionally, the shank can be of different lengths and may be defined in different combinations of the frame bridge recess, heel cushion projection recess and/or the forefoot cushion projection recess, depending on the application. In the arch region 14, the shank 60 also can be distal from and out of contact with the midsole base 46, separated therefrom by the frame bridge 37 interposed between the shank and that midsole base 46 while simultaneously contacting one or both of the heel cushion projection 42 and the forefoot cushion projection 41.

Optionally, when the frame 30 is joined with the midsole 40, the frame can effectively loop around portions of the midsole. For example, as shown in FIGS. 2-5, the frame wall 34 loops forwardly around the forefoot cushion projection 41 and the frame bridge 37 extends rearward of that cushion 41. The frame bridge 37 also can extend forward of the heel cushion 42. The frame wall 34 can extend and loop around that heel cushion 42 via the rearward portion of the lateral frame wall 34L and the medial frame wall 34M with the heel frame wall 34H. The frame wall 34 thus can form an outer boundary around the respective forefoot cushion 41 and the heel cushion 42.

As mentioned above, the sole assembly 20 can include an outsole 50. As shown in FIGS. 2-5, the outsole can comprise multiple individual lugs 54 exposed on the ground contacting surface of the outsole. The outsole can be constructed from a variety of materials, such as natural or synthetic rubber, EVA, polymers or other materials. The outsole can include a raised portion 57 that extends upward from the ground contacting surfaces 50GC of the sole outsole 50. This raised portion 57 in the arch region can be disposed under the midsole base 46 in that region. Of course, this raised portion 57 can be eliminated such that the outsole also includes a ground contact surface in the arch region 14 in certain applications.

The support frame 30 can be physically and/or dynamically interlocked with the midsole 40. As mentioned above, the forefoot cushion 41 can project into and be disposed within the forefoot aperture 31. Likewise, the heel cushion 42 can extend in and be trapped within the heel aperture 32 of the frame 30. This can provide decent interlocking of these components and can generally constrain lateral and torsional movement of the cushions via the frame, so that those cushions can provide cushioning to counteract a downward force from the user's foot on those cushions, without the cushions shifting or swaying laterally and/or medially, again being held and supported with the frame. The frame 30 can be further interlocked with the midsole 40 via the frame wall 34 being disposed in a peripheral recess in the form of a peripheral groove defined by the midsole. The peripheral groove 40G optionally can extend along the lateral and medial sides of the longitudinal axis LA of the sole assembly. The peripheral groove 40G can include a forward groove 40TG that extends and transitions rearward to a lateral groove 40LGF and a medial groove 40MGF. These lateral and medial grooves can extend through the forefoot region 12 along the forefoot cushion 41 and optionally can terminate at the arch region 14, generally slightly rearward of the rear edge 41E of the forefoot cushion 41. These grooves can be bounded by the outer wall 41W of the forefoot cushion 41.

The peripheral groove 40G can include a heel groove 40HG that transitions forward to a lateral groove 40LGH and a medial groove 40MGH. These lateral and medial grooves can extend through the heel region 16 along and around the heel cushion 42 and can terminate at the arch region 14, generally slightly forward of the forward edge 42E of the heel cushion 42. These grooves can be bounded by the outer wall 42W of the heel cushion 42.

The frame wall 34 can be disposed in the peripheral groove 40G and can be disposed particularly in the forward groove 40TG as well as the lateral groove 40LGF and the medial groove 40MGF in the forefoot region 12. The frame wall 34 can be disposed in the peripheral groove 40G and can be disposed in the lateral groove 40LGH and medial groove 40LGM as well as the heel groove 40HG in the heel region 16. Optionally, the frame wall 34 can include forward frame rail 34FR and a rearward or heel frame rail 34HR extending downwardly from the frame wall 34. These frame rails 34FR and 34HR can be the portions of the frame wall that are disposed in the respective groove sections, for example 40LGH, 40MGH, 40LGF and 40MGF. Portions of the frame wall 34 can extend upwardly and above the respective grooves and can be exposed on the exterior of the sole assembly, while the rails remain disposed in the grooves and concealed by an external or exterior midsole wall as described below.

Optionally, the midsole 40 can include a midsole exterior wall 45. As shown in FIGS. 2-4, this exterior wall 45 can extend around the forefoot cushion 41 and the heel cushion 42 of the midsole 40. The midsole exterior wall 45 can be separated from the cushion 41 by respective portions of the peripheral groove 40G disposed between the respective cushion and that midsole exterior wall. The midsole exterior wall 45 optionally can be subdivided into midsole exterior wall parts 45LGF, 45MGF, 45LGH, 45LGM, which are disposed adjacent the respective portions of the peripheral groove. This midsole exterior 45 wall can be disposed on the opposite side of the respective portions of the peripheral groove from the sidewall of the 41W of the cushion 41 and the outer sidewall 42W of the cushion 42.

Further optionally, in addition to interlocking of the frame 30 with the midsole 40 via the frame wall being disposed in a respective peripheral recess or groove 40MG of the midsole, respective ones of the frame 30 and midsole 40 can include a system of interlocking teeth disposed in respective recesses. An example of this is shown with reference to FIGS. 2 and 3. As shown there, the midsole exterior wall 45LGF can include a first tooth 49. This first tooth 49 can project upwardly from the adjacent lateral forefoot groove 40LGF generally alongside an exterior frame wall 34 of the frame. The exterior frame wall 34 can define a downward extending first recess 39. This first recess 39 can receive the corresponding first tooth 49 so the tooth can be secured to the frame 30 along and/or around the recess. Of course, in other applications, the first tooth can be associated with the frame 30 and the recess can be associated with the midsole 40, again with the first tooth disposed in the first recess to provide an interlocking relationship between the teeth and the recesses and thus the frame and the midsole.

As shown in FIG. 2, the first tooth and first recess can be repeated along the forefoot such that there are multiple first teeth extending around the forefoot region and multiple first recesses in that same forefoot region. These multiple teeth of the midsole can form an undulating upper edge 49E around the forefoot exterior and around but outward from the forefoot cushion 41. The undulating upper edge 49E can include upper portions and indentations extending downwardly therefrom, with each individual tooth separated from the next tooth or other component by an indentation or a gap separating the adjacent teeth. The frame 30 likewise can include multiple recesses that undulate along the frame wall 34, with each recess separated from the next by a thicker more filled in portion of the frame wall not having a recess. The undulations in the respective midsole exterior wall and frame wall can correspond to the respective first teeth and first recesses in an interlocking relationship along those walls. The indentations can correspond to the filled in portions or areas without the recesses. In some cases, the teeth and recess can be in an aesthetic sawtooth configuration to provide a visual effect along the midsole.

It will be appreciated that the interlocking teeth and recesses along the exterior portions of the frame and the exterior midsole wall can be repeated in the heel region 16 and can generally extend around the heel cushion 42. This is shown in FIGS. 2 and 4, where teeth 49H of the exterior midsole wall 45LGH are disposed in recesses 39H of the frame 30. Optionally, the teeth and recesses of the respective midsole 40 and frame 30 do not extend to the interior of the frame wall, but optionally can be disposed along only the exterior surface of the frame wall 34. The teeth also optionally can be absent around the frame bridge 37 generally in the arch region 14. There, the upward projection 57 of the outsole 50 can extend upwardly, separating the midsole exterior wall 45 into a forward portion and a rearward portion, so it is visually separated along an exterior of the footwear 10 with the upwardly extending portion 57 of the outsole 50.

Optionally, the first recess 39 can include a depth D6 that is less than the overall thickness T6 of the wall 34. The tooth 49 can be of a thickness T7 that can be greater than equal to or less than the depth D6 of the recess. In some cases, T7 can be greater than D6 so that the tooth projects slightly from the exterior surface of the wall 34. The other recesses and teeth of the midsole and outsole respectively can have similar or identical depth and thickness relationships and will not be repeated here.

The interlocking of the teeth and recesses of the frame wall 34 and the exterior midsole wall 45 can provide stability and further offer rigid structural support around the perimeter of the sole assembly, outward from the respective forefoot cushion 41 and heel cushion 42. In some applications, that structure can further be supplemented by additional sets of second teeth and second recesses. For example, as shown in FIG. 2, the midsole exterior wall 45 can define multiple second recesses 48 disposed laterally outward and distal from the forefoot aperture and the forefoot cushion 41. The outsole 50 can include multiple second teeth 58 defined along an outsole exterior wall 55 of the outsole 50. These second teeth 58 can be defined in the forefoot region and the heel region. Likewise, the second recesses 48 can be disposed in the forefoot region and the heel region. The second teeth 58 can be disposed in and are adhered or cemented within respective ones of the second recesses 48 defined by the midsole 40. The teeth can be upwardly extending and cantilevered and can fit and/or interlock within the respective second recesses.

As shown for example in FIG. 1, the respective first teeth can be vertically aligned above the second teeth and the first recesses can be vertically aligned above the second recesses. Of course, the respective first teeth, second teeth, first recesses and second recesses can be offset from one another so that they are not vertically aligned one above the other as shown. There also may be other constructions that contemplate interlocking of the respective outsole exterior wall, midsole exterior wall and/or frame wall to provide extra stability and enhanced torsional bending resistance to the sole assembly.

A first alternative embodiment of the footwear construction 110 and respective sole assembly 120 is shown in FIGS. 6-10. This embodiment is substantially similar or identical to the embodiment described above in structure, function and operation with a few exceptions. For example, in this embodiment, the footwear 110 is in the form of a western or ranch work boot without a lacing system. The sole assembly 120 can include a support frame 130 mounted above a midsole 140 and an outsole 150. The frame 130 can define the forefoot aperture 131 and the heel aperture 132 like the embodiment above, so will not be described again here. The midsole 140 can include a heel cushion 142 and a forefoot cushion 141 that fit within the respective heel aperture 132 and forefoot aperture 131 defined by the frame 130 substantially similar to the embodiment described above. The outsole 150 can be mounted and joined with the lower surface of the midsole 140, similar to the embodiment described above.

Figure 6:
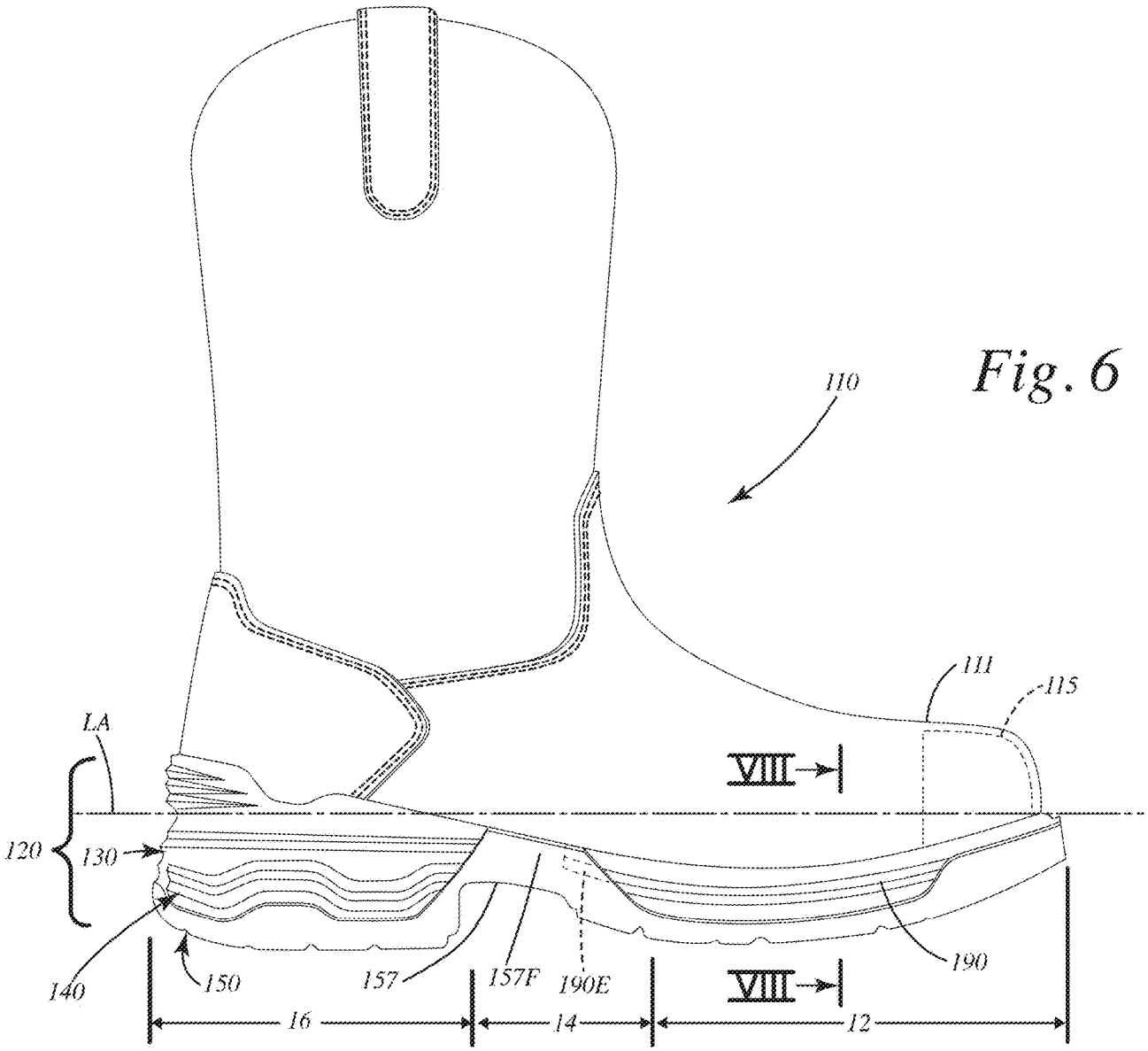
FIG. 6 is a side view of an alternative embodiment of the footwear construction.
Figure 7:
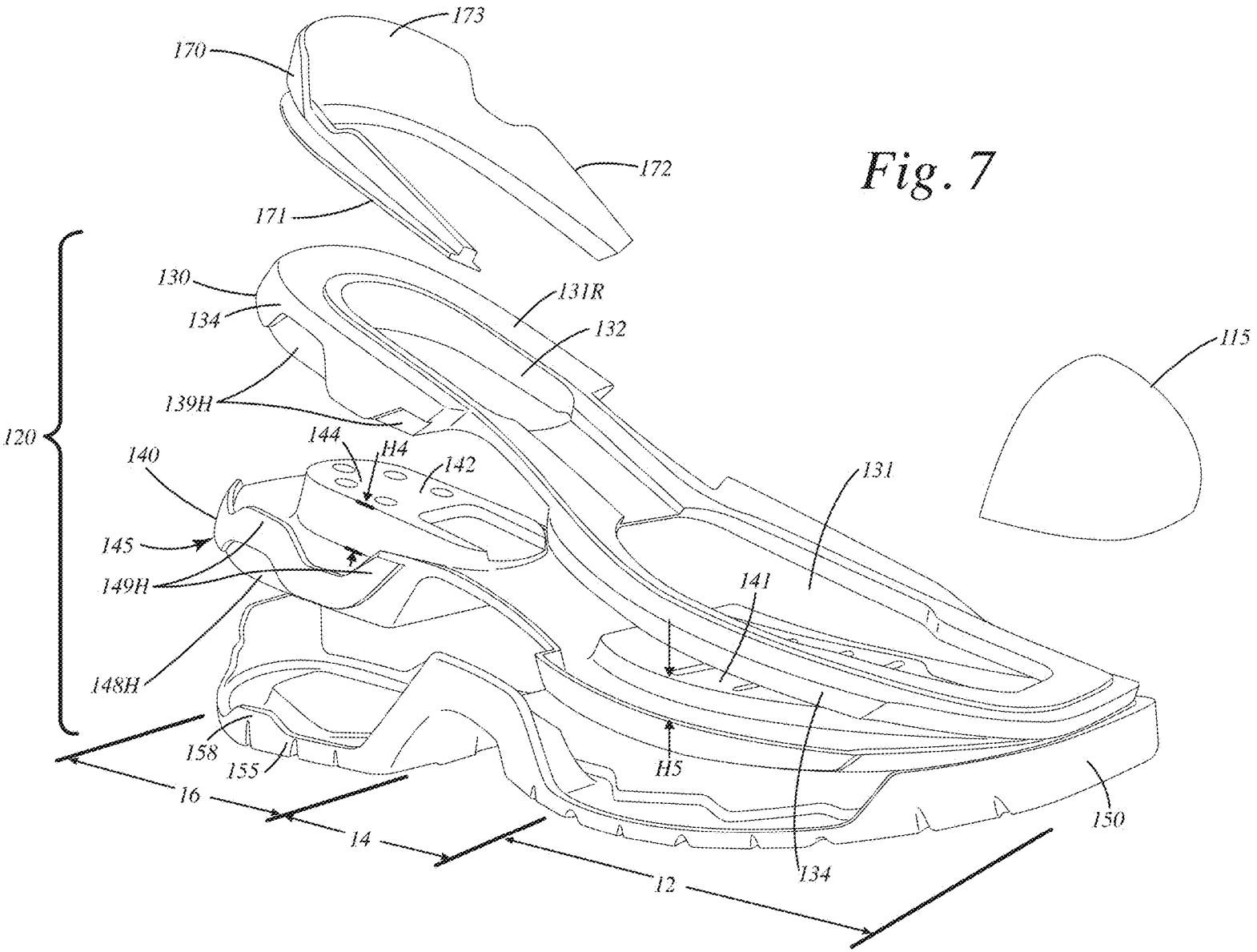
FIG. 7 is a perspective exploded view thereof.

In this embodiment, however, the interlocking teeth and recesses can be isolated primarily in the heel region 16. As shown in FIGS. 6 and 7, the frame 130 can define multiple recesses 139H into which multiple teeth 149H of the midsole interfit. The outsole can include an outsole exterior wall 155 that also includes one or more teeth 158 that are disposed and fit within respective recesses 148H defined by the exterior midsole wall 145. In this embodiment, the heel cushion 142 also can be a height H4 that is substantially greater than the height H5 of the forefoot cushion 141 to provide an elevated heel in the sole assembly 120. In this embodiment as well, the footwear 110 can include a protective toe element 115 however that protective toe element can be an internal protective toe element disposed on the inside of the upper 111. The forefoot region 12 of this construction also can be different from that above in that the exterior frame wall 134 in the forefoot region might not include the interlocking teeth and recesses of the heel region, or alternatively, the exterior frame wall 134 can include only a single large interlocking tooth and recess on the lateral and medial sides int eh forefoot region as shown.

The footwear 110 of this construction also can be slightly altered to include a heel cradle support 170 that can partly fit within a heel cradle support recess 131R that is disposed atop the frame wall 134 in the heel region 16 of the sole assembly 120. The heel cradle support 170 can include a rearward upstanding heel wall 173 and opposing lateral 171 and medial 172 walls. These walls can include respective bases that fit within the heel cradle recess 131R of the frame wall 134. The rearward heel cradle wall 173 optionally can have a greater height than the respective lateral and medial walls of the heel cradle support 170. Of course, in other applications, this heel cradle support may be absent depending on the application.

Figure 8:
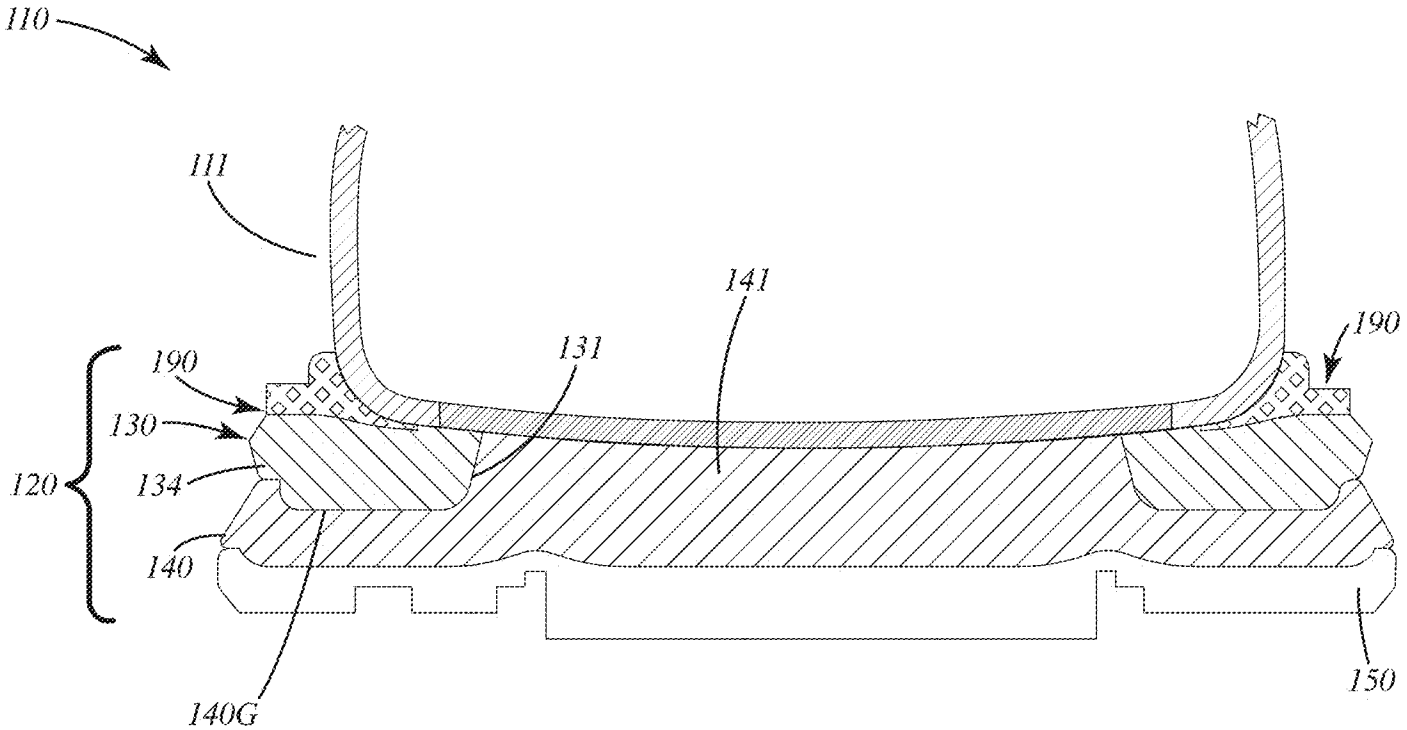
FIG. 8 is a section view of the footwear construction taken along line 8-8 in FIG. 6.

The sole assembly 120 of this embodiment also can include peripheral groove 140G defined by the midsole 140 in which the frame wall 134 of the frame 130 is disposed. As shown in FIG. 8, this embodiment however may also include a real or imitation welt 190 that is disposed atop the frame wall 134 of the frame 130. The welt 190 can extend outwardly, along a portion of the upper 111 in the forefoot region and/or the heel region. Optionally, the welt 190 can terminate at or near the arch region 14 without extending into the heel region 16. In some cases, the end of the welt 190E can be hidden behind and upwardly extending flange 157F of the upward extending portion 157 of the outsole 150. The welt 190 can extend forwardly around the toe and can extend along the lateral and medial sides of the upper and sole assembly on both sides of the footwear.

Although the different elements and assemblies of the embodiments are described herein as having certain functional characteristics, each element and/or its relation to other elements can be depicted or oriented in a variety of different aesthetic configurations, which support the ornamental and aesthetic aspects of the same. Simply because an apparatus, element or assembly of one or more of elements is described herein as having a function does not mean its orientation, layout or configuration is not purely aesthetic and ornamental in nature.

Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientation(s).

In addition, when a component, part or layer is referred to as being "joined with," "on," "engaged with," "adhered to," "secured to," or "coupled to" another component, part or layer, it may be directly joined with, on, engaged with, adhered to, secured to, or coupled to the other component, part or layer, or any number of intervening components, parts or layers may be present. In contrast, when an element is referred to as being "directly joined with," "directly on," "directly engaged with," "directly adhered to," "directly secured to," or "directly coupled to" another element or layer, there may be no intervening elements or layers present. Other words used to describe the relationship between components, layers and parts should be interpreted in a like manner, such as "adjacent" versus "directly adjacent" and similar words. As used herein, the term "and/or" includes any and all combinations of one or more of the associated listed items.

The above description is that of current embodiments of the invention. Various alterations and changes can be made without departing from the broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular. Any reference to claim elements as "at least one of X, Y and Z" is meant to include any one of X, Y or Z individually, any combination of X, Y and Z, for example, X, Y, Z; X, Y; X, Z; Y, Z, and/or any other possible combination together or alone of those elements, noting that the same is open ended and can include other elements.

Reference throughout this specification to "a current embodiment" or "an embodiment" or "alternative embodiment" means that a particular feature, structure, or characteristic described in connection with the embodiment is included in at least one embodiment herein. Accordingly, the appearance of the phrases "in one embodiment" or "in an embodiment" or "in an alternative embodiment" in various places throughout this specification are not necessarily all referring to the same embodiment. Additionally, the particular features, structures, or characteristics of one embodiment are contemplated for proper and full combination in any suitable manner in one or more other embodiments, which is fully contemplated herein. Further, features, structures, or characteristics of one embodiment or multiple embodiments are readily and completely mixed and matched with any features, structures, or characteristics of any other embodiment or multiple embodiments in varying combinations and permutations.

What is claimed is:

1. A footwear construction comprising:

an upper;

a frame joined with the upper, the frame including a frame base and a frame wall extending upward from the frame base, the frame defining a forefoot aperture in a forefoot region and a heel aperture in a heel region, the forefoot aperture and the heel aperture separated by a frame bridge extending transverse and across a longitudinal axis of the frame and located in an arch region that is between the heel region and the forefoot region;

a midsole extending under the frame, the midsole having a lower durometer than the frame, the midsole including a midsole base and a forefoot cushion projection extending upward from the midsole base and in the forefoot aperture, the midsole including a heel cushion projection extending upward from the midsole and in the heel aperture, the frame bridge disposed between the forefoot cushion projection and the heel cushion projection, the midsole defining a peripheral groove extending around at least a portion of the forefoot cushion projection and at least a portion of the heel cushion projection, the frame wall being nested in the peripheral groove; and an outsole joined with and disposed under the midsole to form a ground contacting surface, whereby the forefoot cushion projection and the heel cushion projection provide direct underfoot cushioning and the frame provides a rigid structure around the forefoot cushion projection and the heel cushion projection thereby providing stability to a user's foot when disposed in the upper.

2. The footwear construction of claim 1, wherein the frame wall includes a frame wall interior surface and a frame wall exterior surface, wherein the frame wall exterior surface defines a plurality of first recesses without extending to the frame wall interior surface.

3. The footwear construction of claim 2, wherein the peripheral groove is bounded by a midsole exterior wall and at least one of the forefoot cushion projection and the heel cushion projection, wherein the midsole exterior wall includes a plurality of first teeth that extend upwardly and terminate at a distal first tooth tip, wherein each of the plurality of first teeth is disposed in a respective one of the plurality of first recesses in an interlocking configuration.

4. The footwear construction of claim 3, wherein the outsole includes an outsole exterior wall, wherein the outsole exterior wall includes a plurality of second teeth that extend upwardly and terminate at a distal second tooth tip.

5. The footwear construction of claim 4, wherein the midsole exterior wall defines a plurality of second recesses, wherein each of the plurality of second teeth is disposed in respective ones of the plurality of second recesses in an interlocking configuration along the midsole exterior wall.

6. The footwear construction of claim 1, wherein the peripheral groove includes a lateral groove extending along a lateral side of the midsole in the forefoot region and a medial groove extending along the lateral side of the midsole in the forefoot region, wherein the forefoot cushion projection extends upwardly between the lateral groove and the medial groove.

7. The footwear construction of claim 6, wherein the peripheral groove includes another lateral groove extending along a lateral side of the midsole in the heel region and another medial groove extending along the lateral side of the midsole in the heel region, wherein the heel cushion projection extends upwardly between the other lateral groove and the other medial groove.

8. The footwear construction of claim 1, comprising:

a shank extending over the heel cushion projection, the frame bridge and the forefoot cushion projection, through an arch region located between the forefoot region and the heel region.

9. The footwear construction of claim 4, wherein the frame bridge defines a bridge recess, wherein the forefoot cushion projection defines a forefoot cushion projection recess, wherein the heel cushion projection defines a heel cushion projection recess, wherein the shank is simultaneously disposed in the bridge recess, the forefoot cushion projection recess and the heel cushion projection recess.

10. The footwear construction of claim 1 comprising:

a plurality of first recesses defined along a frame wall exterior surface disposed laterally outward and distal from the forefoot aperture, a plurality of first teeth defined along a midsole exterior wall disposed laterally outward from the peripheral groove and separated by a gap from the forefoot cushion, the plurality of first teeth disposed in respective ones of the plurality of first recesses, a plurality of second recesses defined along the midsole exterior wall disposed laterally outward and distal from the forefoot aperture, a plurality of second teeth defined along an outsole exterior wall, the plurality of second teeth disposed in respective ones of the plurality of second recesses, wherein the first recesses are vertically aligned above the second recesses, wherein the first teeth are vertically aligned above the second teeth.

11. A footwear construction comprising:

an upper forming a void configured to receive a foot of a user, the upper including a lower portion;

a Strobel board closing the lower portion of the upper and configured to extend under the foot when the foot is in the void;

a frame joined with the upper and extending longitudinally from a forefoot region through an arch region to a heel region, the frame including a longitudinal axis extending from the forefoot region to the heel region, the frame including a frame base and a frame wall extending upwardly from a frame base in the forefoot region and the heel region, the frame defining a forefoot aperture in the forefoot region configured to extend under a metatarsalphalangeal joint of the foot, the frame defining a heel aperture in the heel region configured to extend under a heel of the foot, the forefoot aperture and the heel aperture separated by a frame bridge extending transverse and across the longitudinal axis, the frame constructed from a first material having a first durometer;

a midsole extending from the forefoot region to the heel region below the frame, the midsole constructed from a second material having a second durometer that is less than the first durometer, the midsole including a forefoot cushion projection extending in the forefoot aperture and configured to extend under a metatarsalphalangeal joint of the foot, the forefoot cushion projection extending a majority of a length of the forefoot region in the forefoot aperture, the midsole including a heel cushion projection extending in the heel aperture and configured to extend under the heel of the foot, the frame bridge disposed between the forefoot cushion projection and the heel cushion projection, the midsole defining a peripheral groove extending around at least a portion of the forefoot cushion projection and at least a portion of the heel cushion projection, the frame wall being nested in the peripheral groove and disposed at least a portion of the forefoot cushion projection and at least a portion of the heel cushion projection, whereby the forefoot cushion projection and the heel cushion projection provide direct underfoot cushioning and the frame provides a rigid structure around the forefoot cushion projection and the heel cushion projection thereby providing stability to a user's foot when disposed in the upper.

12. The footwear construction of claim 11, wherein the frame wall includes a lateral frame wall and a medial frame wall disposed on opposite sides of the forefoot aperture and the heel aperture, wherein frame bridge connects the lateral frame wall and the medial frame wall, wherein the lateral frame wall and the medial frame wall are joined with one another forward of the forefoot aperture and rearward of the heel aperture, wherein the forefoot aperture and the heel aperture are the only apertures defined entirely through the frame base.

13. The footwear construction of claim 12, wherein the peripheral groove includes a lateral forefoot groove, wherein the midsole includes a lateral midsole exterior wall spaced from the forefoot cushion projection, wherein the lateral forefoot groove extends along and between the lateral midsole exterior wall and the forefoot cushion projection, wherein the lateral frame wall is disposed at least partially in the lateral forefoot groove.

14. The footwear construction of claim 13, wherein the peripheral groove includes a lateral heel groove, wherein the lateral heel groove extends along and between the lateral midsole exterior wall and the heel cushion projection, wherein the lateral frame wall is disposed at least partially in the lateral heel groove.

15. The footwear construction of claim 11, wherein the midsole includes a midsole arch portion in the arch region that is lower than the forefoot cushion projection and the heel cushion projection, wherein the frame bridge is joined with the midsole arch portion and nested between the forefoot cushion projection and the heel cushion projection so that an upper surface of the midsole arch portion is flush with an upper surface of the forefoot cushion projection and an upper surface of the heel cushion projection.

16. The footwear construction of claim 11 comprising:

a plurality of first recesses defined along a frame wall exterior surface disposed laterally outward and distal from the forefoot aperture, a plurality of first teeth defined along a midsole exterior wall disposed laterally outward from the peripheral groove, the plurality of first teeth disposed in respective ones of the plurality of first recesses.

17. A footwear construction comprising:

an upper;

a frame joined with the upper, the frame including a frame base and a frame wall extending upward from the frame base, the frame defining at least one of a forefoot aperture and a heel aperture, the frame including a frame bridge extending transverse and across a longitudinal axis of the frame and located in an arch region that is between a heel region and a forefoot region;

a midsole extending under the frame, the midsole having a lower durometer than the frame, the midsole including a midsole base and a cushion projection extending upward from the midsole base and in the at least one of the forefoot aperture and the heel aperture, the frame bridge disposed adjacent the cushion projection, the midsole defining a peripheral groove extending around at least a portion of cushion projection, the peripheral groove being located between the cushion projection and a midsole exterior wall, the frame wall being nested in the peripheral groove around a perimeter of the cushion projection; and an outsole joined with and disposed under the midsole to form a ground contacting surface, whereby the cushion projection provides direct underfoot cushioning and the frame provides a rigid structure around the cushion projection thereby providing stability to a user's foot when disposed in the upper.

18. The footwear construction of claim 17, wherein the frame wall is an exterior frame wall, wherein at least one of the midsole exterior wall and the exterior frame wall includes first teeth, wherein the other of the at least one of the midsole exterior wall and the exterior frame wall defines first recesses, wherein the first teeth are disposed in the first recesses to interlock the midsole exterior wall and the exterior frame wall.

19. The footwear construction of claim 18 comprising:

wherein the outsole includes an exterior outsole wall, wherein at least one of the midsole exterior wall and the exterior outsole wall includes second teeth, wherein the other of the at least one of the midsole exterior wall and the exterior outsole wall defines second recesses, wherein the second teeth are disposed in the second recesses to interlock the midsole exterior wall and the exterior outsole wall.

20. The footwear construction of claim 17, wherein the frame wall loops around a rear of the cushion projection in the heel region, wherein the frame defines a heel aperture, wherein the frame bridge closes the heel aperture forward of the heel aperture, wherein the frame wall is interlocked with a midsole exterior wall extending upward adjacent and bounding the peripheral groove via a plurality of first teeth nested in a plurality of first recesses disposed laterally outward from the peripheral groove, wherein the frame wall is interlocked with an exterior outsole wall extending upward adjacent the frame wall via a plurality of second teeth nested in a plurality of second recesses disposed laterally outward from the peripheral groove, wherein the first recesses, first teeth, second recesses and second teeth are vertically aligned one above the other.

* * * * *